US006619978B2

(12) United States Patent
Okabe et al.

(10) Patent No.: US 6,619,978 B2
(45) Date of Patent: Sep. 16, 2003

(54) LEVER TYPE CONNECTOR

(75) Inventors: Toshiaki Okabe, Shizuoka-ken (JP); Tetsuya Yamashita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/157,497

(22) Filed: May 30, 2002

(65) Prior Publication Data

US 2002/0182918 A1 Dec. 5, 2002

(30) Foreign Application Priority Data

May 31, 2001 (JP) ..... 2001-165106

(51) Int. Cl.[7] ..... H01R 13/62
(52) U.S. Cl. ..... 439/372
(58) Field of Search ..... 439/157, 153, 439/160, 352, 372

(56) References Cited

U.S. PATENT DOCUMENTS

| | | | | |
|---|---|---|---|---|
| 5,230,635 A | * | 7/1993 | Takenouchi et al. | 439/153 |
| 5,888,081 A | * | 3/1999 | Konoya et al. | 439/157 |
| 5,971,779 A | * | 10/1999 | Okabe | 439/157 |
| 5,975,929 A | * | 11/1999 | Matsuura et al. | 439/157 |
| 6,019,620 A | * | 2/2000 | Kodama et al. | 439/157 |
| 6,164,991 A | * | 12/2000 | Matsuura et al. | 439/157 |
| 6,247,945 B1 | * | 6/2001 | Wakui et al. | 439/157 |
| 6,312,273 B1 | * | 11/2001 | Hasegawa et al. | 439/153 |

FOREIGN PATENT DOCUMENTS

| | | |
|---|---|---|
| EP | 0 895 316 A1 | 2/1999 |
| GB | 1 340 317 | 12/1973 |

OTHER PUBLICATIONS

GB 1,340,317 A (Inventio) –See axis 8.1 in slot 10.

EP 0,895,316 A1 (Sumitomo) –See axle 13 in hole 33.

* cited by examiner

*Primary Examiner*—Lynn Field
*Assistant Examiner*—Phuong KT Dinh
(74) *Attorney, Agent, or Firm*—Finnegan, Henderson, Farabow, Garrett, & Dunner, L.L.P.

(57) ABSTRACT

A lever type connector is provided with a male housing (39), a rotatable lever (41) in which a portion between one side and another side in a longitudinal direction is connected to the male housing (39), a connection portion (43) for connecting the lever (41) to the male housing (39), and a female housing (45) in which the male housing (39) is received and fitted. Further, the connection portion (43) is constituted by projection portion (51) provided to either one of the male housing (39) and the lever (41), and engagement hole (75) provided in another of the male housing (39) and the lever (41), engaging with the projection portion (51), and formed to be long toward one side of the lever (41) with respect to the projection portion (51). The lever (41) can be displaced to another side with respect to a fitting position in a fitting state between the male housing (39) and the female housing (45) in a normal state.

10 Claims, 6 Drawing Sheets

LEVER TYPE CONNECTOR

BACKGROUND OF THE INVENTION

1. Field of the Invention

The present invention relates to a lever type connector which fits a male housing to a female housing by rotating a lever mounted to the male housing.

2. Description of the Related Art

In a proposed lever type connector, there is a structure shown in FIGS. 1 to 3. A lever type connector 1 is provided with a male housing 3, a rotatable lever 5 in which a portion between one side and another side in a longitudinal direction is connected to the male housing 3, a connection portion 7 for connecting the lever 5 to the male housing 3, and a female housing 9 in which the male housing 3 is received and fitted.

The male housing 3 has a plurality of terminal receiving chambers 11 in which terminals, which are not shown, are respectively received. A projection portion 13 is formed on both side surfaces in a width direction of the male housing 3. The male housing 3 protrudes along a vertical direction of one side in the longitudinal direction, and a guide rib 17 having a through hole 15 is formed.

The lever 5 is provided with a pair of side wall 19 arranged so as to oppose each other via the male housing 3, and an operation portion 20 which connects the side walls 19 and 19 to each other in an upper portion of another side in the longitudinal direction. A protruding portion 21 received within the through hole 15 of the guide rib 17 is provided in one side of the longitudinal direction of the side wall 19. An engagement hole 23 engaging with the projection portion 13 of the male housing 3 is provided in the side wall 19. An engagement projection 25 is protruded from a lower portion of an outer side surface between the protruding portion 21 and the engagement hole 23, in the side wall 19.

The connection portion 7 is constituted by the projection portion 13 provided in the male housing 3, and the engagement hole 23 is provided in the lever 5. The connection portion 7 is structured such that the projection portion 13 and the engagement hole 23 are engaged respectively so as to connect the portion between one side and another side of the lever 5 to the male housing 3. The lever 5 rotates around the projection portion 13.

The female housing 9 has a hood portion 27 to which the male housing 3 is fitted. An engagement groove 31 is provided along a vertical direction, on an inner peripheral surface of the hood portion 27. The engagement groove 31 corresponds to the engagement projection 25 of the lever 5. The engagement groove 31 of the hood portion 27 has an engagement step portion 29 with which the engagement projection 25 is engaged at a time when the lever 5 rotates. The engagement step 29 forms a supporting point together with the engagement projection 25. A guide groove 33 to which the guide rib 17 is inserted is provided at positions corresponding to the guide rib 17 of the male housing 3, on an inner peripheral surface of the hood portion 27. A plurality of opposing terminals 35 connected to the terminals of the male housing 3 are protruded from a bottom surface in an inner portion of the hood portion 27.

In the lever type connector 1, when fitting the male housing 3 to the female housing 9, the engagement projections 25 and 25 of the lever 5 are engaged with the engagement step portions 29 and 29 of the engagement grooves 31 and 31 in the female housing 9 so as to form a supporting point. Further, the operation portion 20 of the lever 5 is pressed to a lower portion corresponding to a front end side in a fitting direction between the male housing 3 and the female housing 9 so as to be rotated. The male housing 3 is directly pressed by the application of force to the projection portion 13 due to a lever effect of the rotating lever 5 and a pressing force for pressing the operation portion 20. Accordingly, the male housing 3 moves downward as a whole. As a result, the male housing 3 is fitted within the hood 27 of the female housing 9. In this state, the lever 5 is received within the hood portion 27 of the female housing 9 together with the male housing 3.

In this case, in the lever type connector 1 proposed as mentioned above, the male housing 3 and the female housing 9 are fitted by utilizing the lever effect obtained by the lever 5 rotating around one side corresponding to the supporting point. Accordingly, it is necessary to incline the lever 5 upward from one side to another side in the longitudinal direction in a normal state. Therefore, the lever 5 is arranged obliquely with respect to the vertical direction. In this case, the normal state means a state of inclining the lever 5 upward from one side to another side in the longitudinal direction in a state that the lever is connected to the male housing 3 as shown in FIG. 2. The direction of the force applied to the projection portion 13 of the male housing 3 due to the pressing force for pressing the operation portion 20 at a time of rotating the lever 5 is obliquely downward. As a result, in the lever type connector 1, the male housing 3 is directly pressed downward due to a component force in a vertical direction of the force applied to the projection portion 13, and there is generated a loss in the force which directly presses the male housing 3 downward at a degree of a component force in a direction crossing with the vertical direction of the force applied to the projection portion 13. There is a risk that the operability of the fitting operation between the male housing 3 and the female housing 9 is reduced due to the loss of the pressing force.

However, in the lever type connector 1, in order to compensate for the loss of the force applied to the projection portion 13 of the male housing 3, a size between the projection portion 13 corresponding to an axis of rotation and the operation portion 20 in the lever 5 is increased by extending another side of the lever 5. The force applied to the projection portions 13 is increased by the force due to the lever effect of the rotating lever 5 and the pressing force. Then, the operation portion 20 largely protrudes from the female housing 9 in the fitting state between the female 3 and male housings 9. Accordingly, there is a risk that the structure is enlarged as a whole.

SUMMARY OF THE INVENTION

An object of the present invention is to provide a lever type connector which can improve an operability of a fitting operation between female and male housings without enlarging the size.

The first aspect of the present invention provides a lever type connector comprising: a male housing; a lever in which a portion between one side and another side in a longitudinal direction is rotatably pivoted to the male housing; a female housing for receiving and fitting the male housing; a projection portion provided to either one of the male housing and the lever; and an engagement hole provided in the other of the male housing and the lever, engaging with the projection portion, wherein the engagement hole is formed to be longer toward one side of the lever with respect to the projection portion, and wherein the lever is displaceable to another side with respect to a fitting position when fitting state between the female housing and the male housing in a normal stage.

According to the first aspect structured in the manner mentioned above, when fitting the male housing to the female housing, the lever is previously displaced to another side with respect to the fitting position. In this state, one side is engaged with the side of the female housing from the connection portion of the lever so as to form the supporting point. At this time, when fitting state between the female and male housings, by displacing the lever to one side according to the rotation, the lever can be arranged at the fitting position so as to be received within the female housing together with the male housing.

The second aspect of the present invention provides the lever type connector according to the first aspect of the present invention, wherein the projection portion is provided to the male housing and the engagement hole is provided in the lever.

The third aspect of the present invention provides the lever type connector according to the first aspect of the present invention, wherein the engagement hole is gradually inclined from one side of the lever toward another side of the lever in the normal state of the lever.

According to the third aspect structured in the manner mentioned above, when fitting the male housing to the female housing, in addition to the lever effect due to the rotation of the lever, and a component force in a vertical direction applied to the projection portion due to the pressing force pressing another side to the connection portion of the lever, the engagement hole of the lever displacing to one side slides the projection portion. Accordingly, it is possible to move the male housing to the front end side in the fitting direction of the female housing.

The fourth aspect of the present invention provides the lever type connector according to the first aspect of the present invention, wherein the engagement hole is gradually inclined to a rear end side in a fitting direction of the male housing to the female housing from one side of the lever toward another side in the normal state of the lever, and the engagement hole is curved to the rear end side at a middle portion between one side and another side of the engagement hole, and crosses with the fitting direction at a predetermined rotational position of the lever from the middle portion to the another side, or is slightly inclined in a direction crossing with the fitting direction.

According to the fourth aspect structured in the manner mentioned above, when the lever is displaced to one side, another side slides the projection portion from the middle portion of the engagement hole so as to press against the front end side in the fitting direction. Accordingly, it is possible to reduce the component force generated in the direction crossing with the fitting direction.

The fifth aspect of the present invention provides the lever type connector according to the first aspect of the present invention, further comprising: a holding step portion provided in the lever and the male housing, and engaging with each other when displacing the lever to another side with respect to the fitting position in the normal state.

According to the fifth aspect structured in the manner mentioned above, when displacing the lever to another side with respect to the fitting position in the normal state, the holding steps provided in the lever and the male housing engage with each other. Accordingly, it is possible to maintain the displacement of the lever to another side.

The sixth aspect of the present invention provides the lever type connector according to the first aspect of the present invention, further comprising: a slide guiding portion provided in another side of the lever, which slides to a side of the female housing when the lever rotates.

According to the sixth aspect structured in the manner mentioned above, at a time of fitting the male housing to the female housing, the male housing moves to the front end side in the fitting direction to the female housing. Then, the slide guiding portion of the lever previously displaced to another side with respect to the fitting position slides to the side of the female housing so as to displace the lever to one side. Accordingly, in the fitting state between the male housing and the female housing, it is possible to securely arrange the lever in the fitting position.

The seventh aspect of the present invention provides the lever type connector according to the third aspect of the present invention, wherein the engagement hole is gradually inclined in a fitting direction from one side toward another side with respect to a direction crossing with the fitting direction of the male housing to the female housing in the normal state of the lever.

The eighth aspect of the present invention provides the lever type connector according to the third aspect of the present invention, wherein the engagement hole is gradually inclined in a reverse direction to a fitting direction from one side toward another side with respect to a direction crossing with the fitting direction of the male housing to the female housing in the normal state of the lever.

The ninth aspect of the present invention provides the lever type connector according to the third aspect of the present invention, wherein the engagement hole is gradually inclined along a direction crossing with a fitting direction of the male housing to the female housing in the normal state of the lever.

The tenth aspect of the present invention provides the lever type connector according to the third aspect of the present invention, wherein the engagement hole is inclined in a direction along the longitudinal direction of the lever.

BRIEF DESCRIPTION OF THE DRAWINGS

The invention will now be described with reference to the accompanying drawings wherein.

DETAILED DESCRIPTION OF THE PREFERRED EMBODIMENT

A description will be given below of a first embodiment of a lever type connector according to the present invention.

Figure 1:
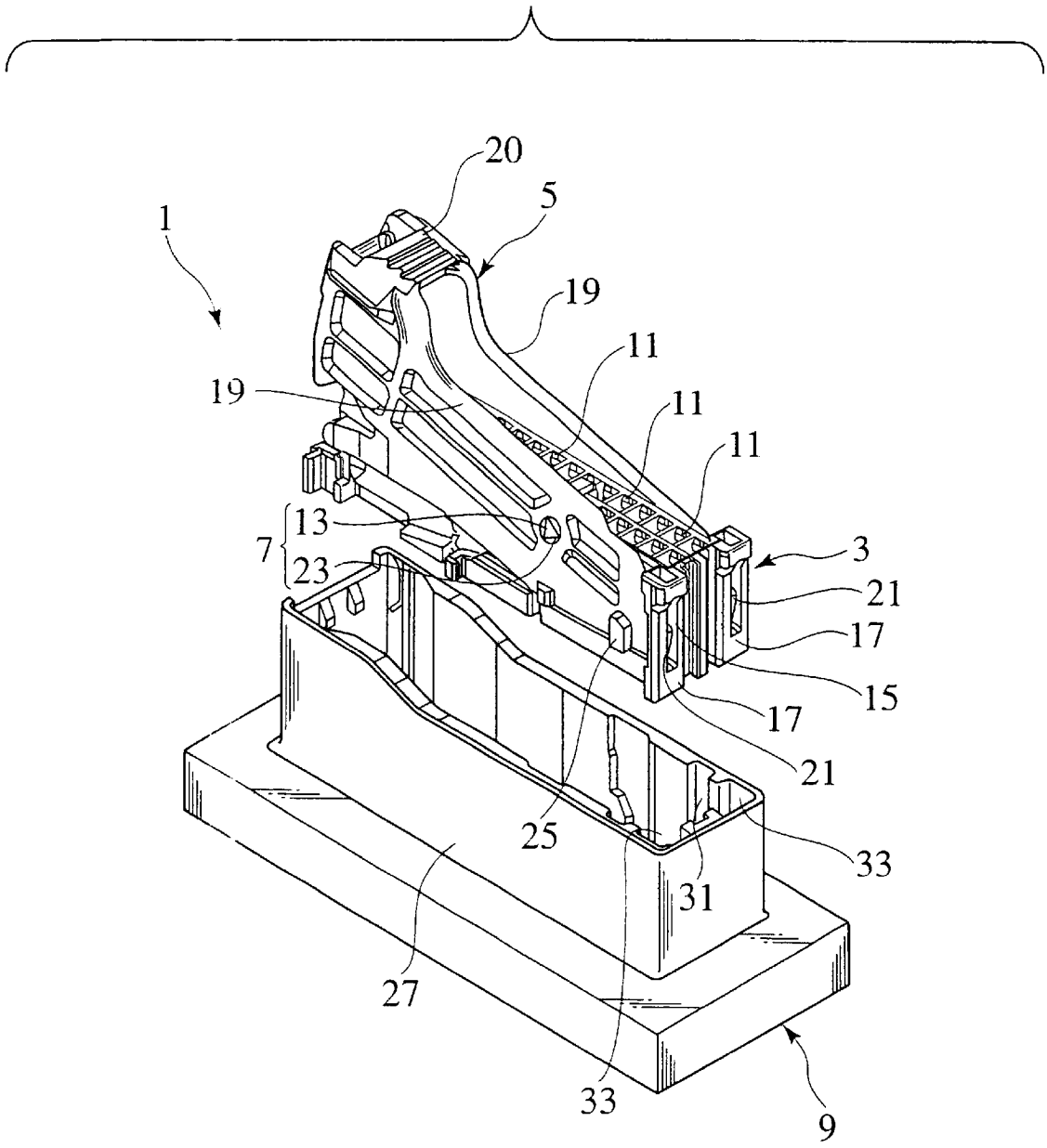
FIG.1 PRIOR ART
FIG. 1 shows a perspective view showing a proposed lever type connector.
Figure 2:
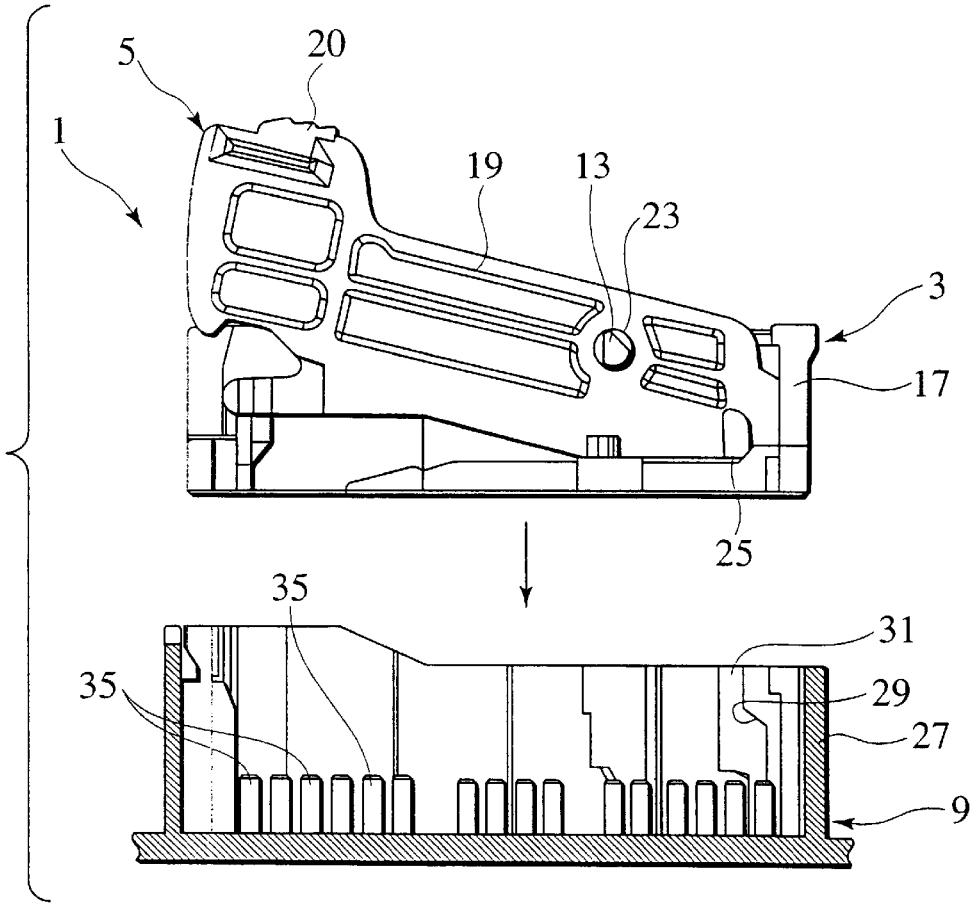
FIG.2 PRIOR ART
FIG. 2 shows a side view of the lever type connector shown in FIG. 1.
Figure 3:
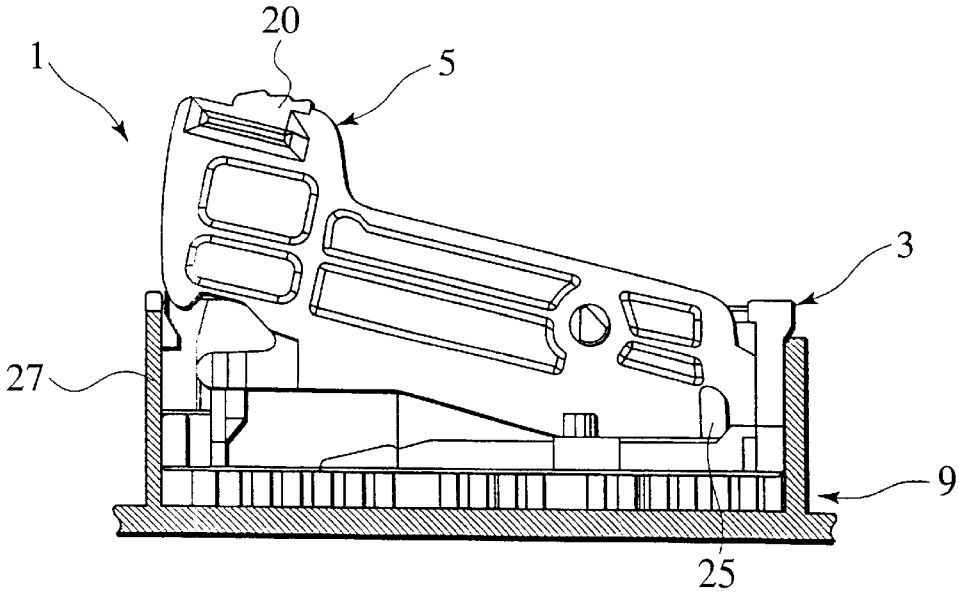
FIG.3 PRIOR ART
FIG. 3 shows a cross sectional view at a time of fitting a male housing to a female housing in the lever type connector shown in FIG. 1.
Figure 4:
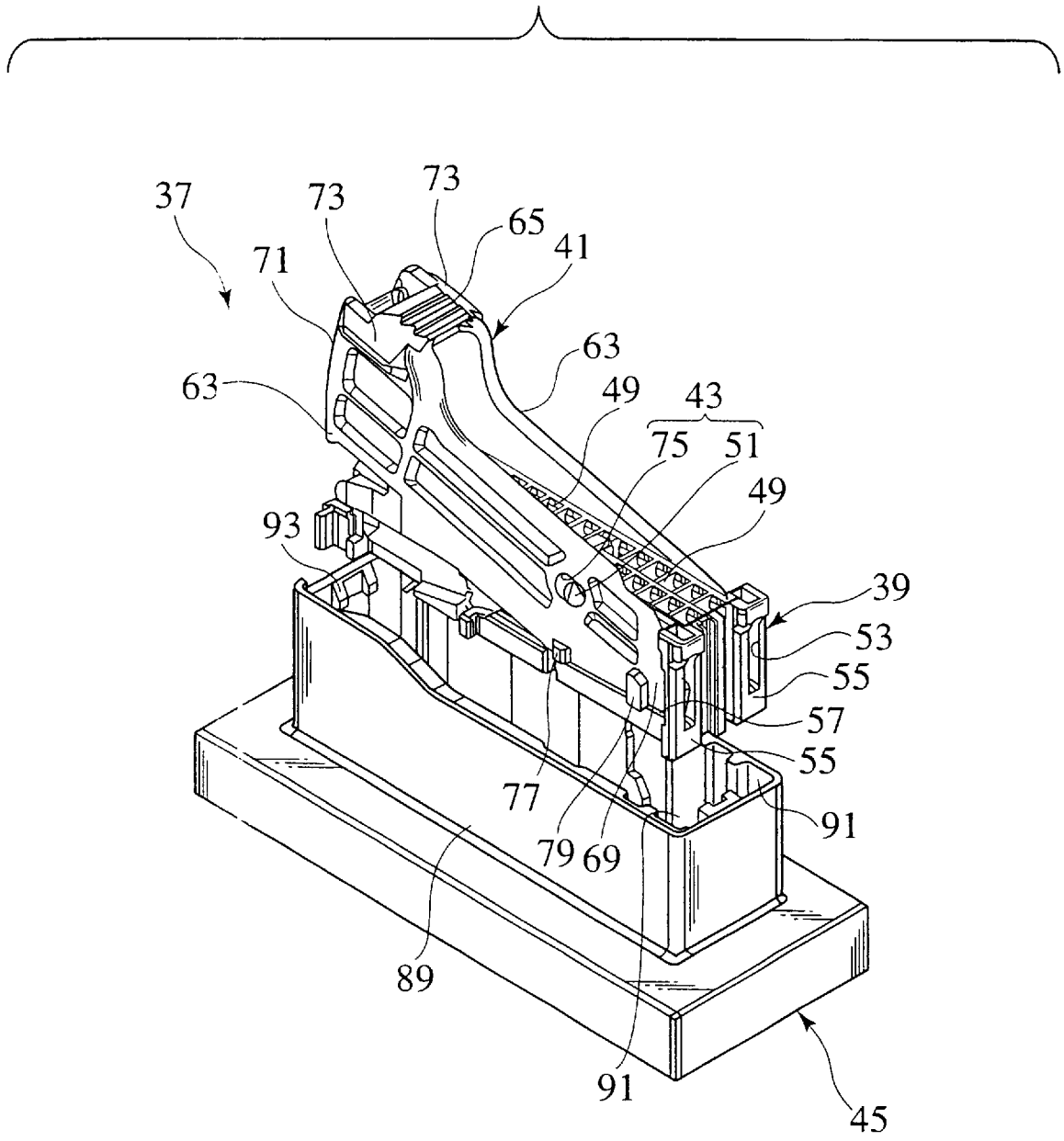
FIG. 4 shows a perspective view showing a first embodiment of a lever type connector according to the present invention.

As shown in FIG. 4, a lever type connector 37 according to the present embodiment is provided with a male housing 39, a rotatable lever 41 in which a portion between one side and another side in a longitudinal direction is connected to the male housing 39, a connection portion 43 for connecting the lever 41 to the male housing 39, and a female housing 45 in which the male housing 39 is received and fitted.

Figure 5:
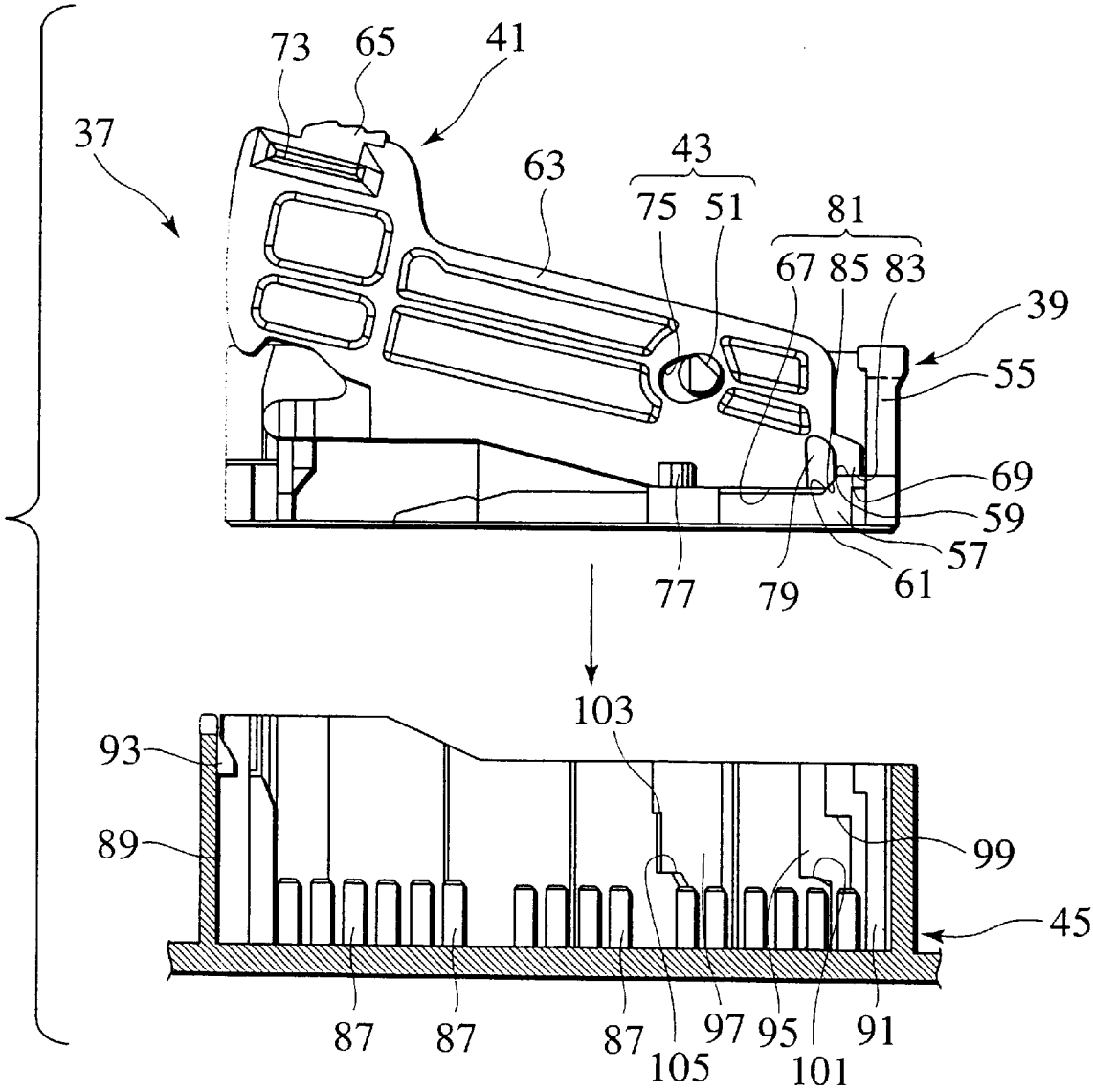
FIG. 5 shows a side view of the lever type connector shown in FIG. 4.

As shown in FIGS. 4 and 5, the male housing 39 has a plurality of terminal receiving chambers 49 which respectively receive terminals, which are not shown, in an inner portion. The male housing 39 has projection portions 51 respectively protruded toward a width direction, on both side surfaces in a width direction of the male housing 39. Further, the male housing 39 has a guide rib 55 protruded along a vertical direction corresponding to a fitting direction between the male housing 39 and the female housing 45 and having a through hole 53 in one side in the longitudinal direction, and a holding step portion 57 provided in one side lower portion corresponding to another side with respect to the guide rib 55.

The holding step portion 57 is protruded in the width direction along the longitudinal direction of the one side lower portion of the side surface. The holding step portion 57 is structured such that an upper surface 59 is formed in a direction crossing with the vertical direction, and another side with respect to the side surface is arranged in a lower portion corresponding to a front end side in the fitting direction between the male housing 39 and the female housing 45. The upper surface 59 of the holding step portion 57 is structured such that a portion between one side and another side is connected by a inclined surface 61 which is gradually inclined downward from one side toward another side.

The lever 41 connected to the male housing 39 is inclined from one side to another side in the longitudinal direction, in a normal state. In this case, the normal state means a state in which the lever 41 is inclined upward from one side to another side in the longitudinal direction when the lever 41 is connected to the male, housing 39 as shown in FIG. 5. Further, the male housing 39 is displaced to another side with respect to the fitting position in the fitting state between the male housing 39 and the female housing 45. The lever 41 is provided with a pair of side walls 63 and 63 arranged so as to oppose each other via the male housing 39, and an operation portion 65 connecting the side walls 63 and 63 in another side in the longitudinal direction. The lever 41 is provided with an engagement portion, which is not shown, on an end surface in another side.

The side wall 63 is formed in a plate-like body having a plurality of openings. The side wall 63 is structured such that a lower surface 67 in one side in the longitudinal direction crosses with the vertical direction in a normal state of the lever 41. The side wall 63 is provided with a protruding portion 69 provided in one side in the longitudinal direction, a slide guiding portion 71 provided to another side, a rib 73 provided to an upper portion in another side, and an engagement hole 75 engaging with the projection portion 51 of the male housing 39. The side wall 63 is provided with a side surface projection 77 arranged approximately immediately below the engagement hole 75 in the normal state of the lever 41, an engagement projection 79 provided between the protruding portion 69 and the engagement hole 75, and a holding step portion 81 provided between the protruding portion 69 and the engagement projection 79.

The protruding portion 69 is protruded from one side in the longitudinal direction of the side wall 63 in the longitudinal direction. The protruding portion 69 is received in the through hole 53 of the guide rib 55 so as to prevent the lever 41 from displacing from the male housing 39. A lower surface 83 of the protruding portion 69 is formed substantially in parallel to the lower surface 67 in one side of the side wall 63. Further, the lower surface 83 is arranged in an upper portion with respect to the lower surface 67 of the side wall 63 in the normal state of the lever 41. The lower surface 83 crosses with the vertical direction so as to be fitted to one side of the upper surface 59 of the holding step portion 57 in the male housing 39.

The slide guiding portion 71 is provided to the opposite side of the projection portion 51. The slide guiding portion 71 is constituted by a curved surface, and is provided along the vertical direction in another side of the side wall 63. The slide guiding portion 71 is formed so as to gradually move close to the engagement hole 75 from the upper portion toward the lower portion.

The rib 73 is provided along the longitudinal direction in the upper portion in another side of the side wall 63, and is operated at a time of canceling the fitting between the male housing 39 and the female housing 45. The engagement hole 75 is provided to one side with respect to the rib 73.

The engagement hole 75 is constituted by a long hole formed long toward one side of the lever 41. The engagement hole 75 is provided at a position biased to one side with respect to a middle portion between one side and another side in the longitudinal direction of the side wall 63. The engagement hole 75 is gradually inclined downward from one side toward another side relative to the direction crossing with the vertical direction in the normal state of the lever 71.

The side surface projection 77 arranged approximately immediately below the engagement hole 75 in the normal state of the lever 41 as shown in FIG. 5 is protruded in a width way direction from the lower portion of the side wall 63. The engagement projection 79 is provided in one side with respect to the side surface projection 77.

The engagement projection 79 is protruded in the width direction from the lower portion of one side in the longitudinal direction, and is arranged in another side with respect to the protruding portion 69. The engagement projection 79 is structured such that an upper surface is gradually inclined upward from one side to another side in the normal state of the lever 41. Further, the structure is such that when the lever 41 rotates to a predetermined position, the upper surface of the engagement projection 79 crosses with the vertical direction.

The holding step portion 81 provided between the engagement projection 79 and the protruding portion 69 is constituted by the lower surface 67 in one side of the side wall 63, the lower surface 83 of the protruding portion 69, and an inclined surface 85 connecting the lower surfaces 67 and 83. The inclined surface 85 is gradually inclined downward from one side to another side in the normal state of the lever 41. The inclined surface 85 is fitted to the inclined surface 61 of the holding step portion 57 in the male housing 39.

The holding step portion 81 is engaged with the holding step portion 57 in the normal state of the lever 41, so that the lower surface 83 and the inclined surface 85 are respectively brought into contact with one side of the upper surface 59 in the housing step portion 57 of the male housing 39 and the inclined surface 61. Accordingly, the holding step portion 81 maintains the displacement state of the lever 41 to another side with respect to the fitting position.

The operation portion 65 mentioned above is structured such that the upper surface is pressed downward so as to form a power point at a time of rotating the lever 41.

Figure 7:
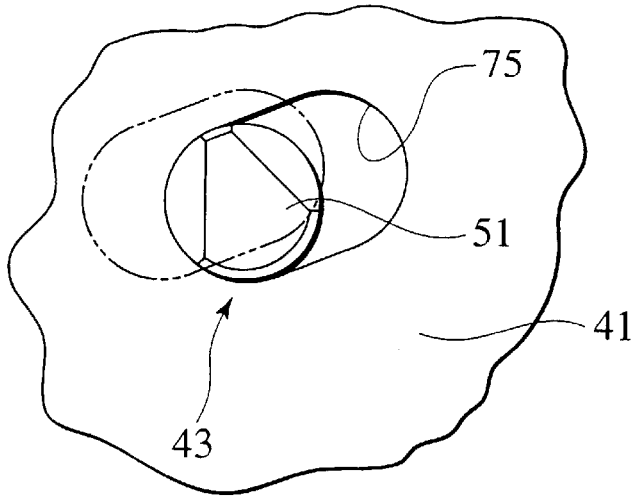
FIG. 7 shows a side view showing a connection portion of the lever type connector shown in FIG. 6.

The lever 41 is connected to the male housing 39 via the connection portion 43. As shown in FIGS. 4, 5 and 7, the connection portion 43 is constituted by the projection portion 51 provided to the male housing 39, and the engagement hole 75 provided in the lever 41. The connection portion 43 connects the portion between one side and another side of the lever 41 to the male housing 39, so that the engagement hole 75 is respectively engaged with the projection portion 51. The connection portion 43 is structured such as to rotate the lever 41 around the projection portion 51. The connection portion 43 can displace the lever 41 to another side with respect to the fitting position by shifting the engagement position comprising engagement with the projection portion 51 of the engagement hole 75 in the normal state of the lever 41.

As shown in FIG. 5, the female housing 45 is structured such that a plurality of opposing terminals 87 connected to the terminals of the male housing 39 are protruded from a bottom surface. The female housing 45 has a hood portion 89 in which the male housing 39 is received and fitted. As shown in FIGS. 4 and 5, an inner peripheral surface of the hood portion 89 has a guide groove 91 provided in one side in the longitudinal direction and to which the guide rib 55 of the male housing 39 is inserted, and an engagement projection 93 provided to another side and engages the male housing 39 in the fitting state between the male housing 39 and the female housing 45. The inner peripheral surface of the hood portion 89 has a engagement groove 95 provided at position corresponding to the engagement projection 79 of the lever 41 and to which the engagement projection 79 is inserted, and a side surface groove 97 provided at a position corresponding to the side surface projection 77 of the lever 41 and to which the side surface projection 77 is inserted.

The guide groove 91 is provided along the vertical direction at a position corresponding to the guide rib 55 of the male housing 39. The engagement projection 93 is provided in an opposite side to the guide groove 91. The engagement projection 93 is structured such as to be protruded inward from another side of the hood portion 89 and to engage with an engagement portion, which is not shown, of the lever 41.

The engagement groove 95 is formed along the vertical direction of the hood portion 89. The engagement groove 95 is structured so that an engagement step portion 99 engaged with the engagement projection 79 at a rotating time of the lever 41 at a time of fitting the male housing 39 to the female housing 45 is provided in one side. Thereby, the engagement step 99 forms a supporting point together with the engagement projection 79. The engagement groove 95 is structured such that a canceling step portion 101 engaged with the engagement projection 79 at a rotating time of the lever 41 at a time of fitting the male housing 39 to the female housing 45 is provided in another side. Thereby, the canceling step portion 101 forms a supporting point together with the engagement projection 79. The side surface groove 97 is provided in another side with respect to the engagement groove 95.

The side surface groove 97 is provided along the vertical direction of the hood portion 89. Further, contact portions 103 and 105 with which the side surface projection 77 of the lever 41 is brought into contact in inserting the male housing 39 to the hood portion 89 at a time of fitting the male housing 39 to the female housing 45, are provided in the side surface groove 97.

In the case of using the lever type connector 37 structured in the manner mentioned above, as shown in FIGS. 4 and 5, the male housing 39 is inserted to a predetermined position within the hood portion 89 of the female housing 45. Next, the lever 41 is rotated. At a time of inserting the male housing 39 to the predetermined position within the hood portion 89 of the female housing 45, the lever 41 is displaced to another side with respect to the fitting position, and the male housing 39 is arranged on the hood portion 89 of the female housing 45. Thereafter, the male housing 39 is moved downward.

When displacing the lever 41 to another side with respect to the fitting position, the holding step portion 57 of the male housing 39 and the holding step portion 81 of the lever 41 are fitted to each other, whereby the displacement state of the lever 41 to another side is maintained. Then, the male housing 39 is arranged on the hood portion 89.

At this time, the guide rib 55 of the male housing 39 is brought into line with the guide groove 91 of the hood portion 89. Further, the engagement projection 79 of the lever 41 is brought into line with the side surface projection 77, and the engagement groove 95 of the hood portion 89 is brought into line with the side surface groove 97, respectively.

In this state, a lower side of the slide guiding portion 71 in the lever 41 is arranged on an opening edge of another side of the hood portion 89. Further, an upper side of the slide guiding portion 71 is arranged in an outer side with respect to the hood portion 89.

When moving the male housing 39 downward, the male housing 39 is inserted within the hood portion 89 of the female housing 45. At this time, the guide rib 55 of the male housing 39 is inserted into the guide groove 91 of the hood portion 89. Further, the engagement projection 79 and the side surface projection 77 in the lever 41 are respectively inserted within the engagement groove 95 and the side surface groove 97. Accordingly, the insertion of the male housing to the hood portion 89 in the female housing 45 is guided.

The lever 41 is structured such that the side surface projection 77 is brought into contact with the contact portions 103 and 105 within the side surface groove 97 according to the insertion of the male housing 39 to the hood portion 89 of the female housing 45. Accordingly, an improvident rotation of the lever 41 is restricted. After inserting the male housing 39 in the predetermined insertion position to the hood portion 89 in the manner mentioned above, the lever 41 is rotated.

At a time of rotating the lever 41, the operation portion 65 of the lever 41 is pressed downward. When pressing downward the operation portion 65 of the lever 41, the engagement projection 79 of the lever 41 respectively engages with the engagement step portion 99 of the engagement groove 95 in the hood portion 89 so as to form the supporting point. In this state, the operation portion 65 of the lever 41 is pressing downward, the lever 41 rotates, and the engagement projection 79 presses the engagement step portion 99 of the hood portion 89 upward.

At this time, since the lever is displaced to another side with respect to the fitting position, a distance between the projection portion 51 of the male housing 39 corresponding to an axis for rotation and the operation portion 65 corresponding to the power point is lengthened. Accordingly, the force by which the engagement projection 79 presses the engagement step portion 99 of the hood portion 89 is increased.

A force moving the lever 41 obliquely downward to another side is applied to the lever 41 due to the pressing force pressing the operation portion 65 downward, and the lever 41 moves in the direction of the force as a whole. At this time, since the engagement hole 75 of the lever 41 is engaged with the projection portion 51 of the male housing 39, the inner peripheral surface of the engagement hole 75 presses the outer peripheral surface of the projection portion 51 in the obliquely downward direction toward another side.

As a result, the male housing 39 moves downward by being directly pressed downward due to the lever effect of the rotating lever 41 and a component force in the vertical direction of the force being applied to the projection portion 51.

Figure 6:
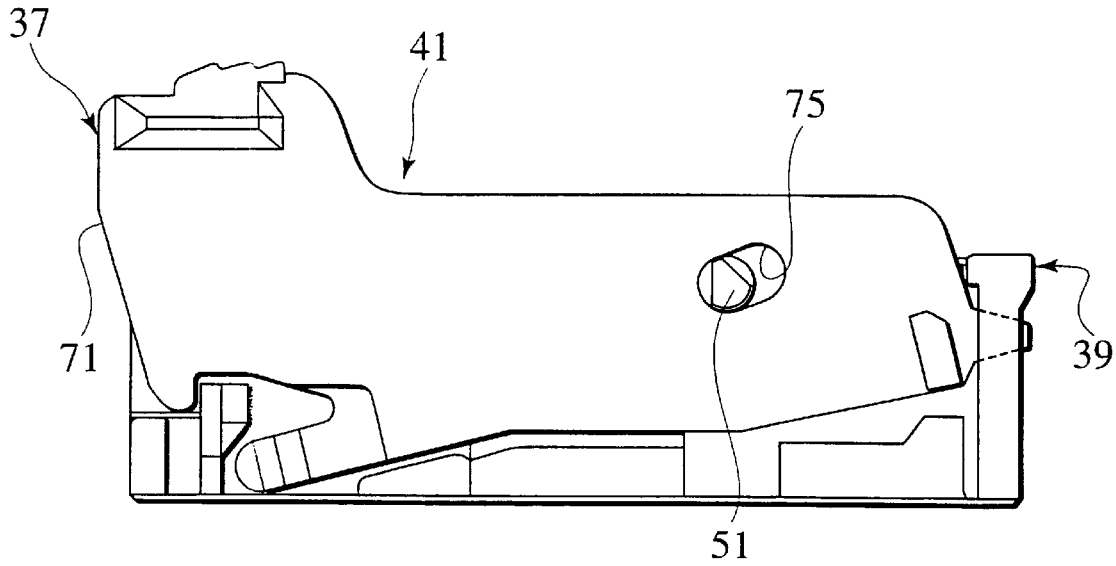
FIG. 6 shows a side view of the male housing in a state of fitting a male housing to a female housing in the lever type connector shown in FIG. 4.

As shown in FIGS. 6 and 7, when the male housing 39 moves downward, the slide guiding portion 71 of the lever 41 slides the opening edge of another side of the hood portion 89, which is not shown, so as to displace the lever 41 to one side due to its own curvature. At this time, the engagement hole 75 of the lever 41 moves the projection portion 51 of the male housing 39, whereby the engagement position with the projection portion 51 is shifted to one side from another side. Further, since the engagement hole 75 is gradually inclined downward relative to the vertical direction from one side toward another side, it presses downward by sliding the projection portion 51. As a result, the lever 41 moves the male housing 39 downward in correspondence to the displacement to one side.

In the manner mentioned above, when the male housing 39 is received and fitted within the hood portion 89 of the female housing 45, the engagement projection 93 of the hood portion 89 engages with the engagement portion, which is not shown, of the lever 41 so as to maintain the fitting state between the male housing 39 and the female housing 45.

As shown in FIG. 7, the lever 41 is completely displaced to the fitting position, and is received within the hood portion 89 together with the male housing 39.

At a time of canceling the fitting state between the male housing 39 and the female housing 45 fitted in the manner mentioned above, the rib 73 is pulled upward by gripping the lower surface of the rib 73 in the lever 41, which is not illustrated. At this time, the lever 41 is structured so that the engagement projection 79 engages with the canceling step portion 101 of the engagement groove 95 in the hood portion 89 so as to form the supporting point. Then, the lever 41 is rotated. As a result, it is possible to cancel the fitting state between the male housing 39 and the female housing 45 on the basis of the lever effect obtained by the rotation of the lever 41.

In the lever type connector 37 according to the present embodiment mentioned above, at a time of fitting the male housing 39 to the female housing 45, the lever 41 is previously displaced to another side with respect to the fitting position so as to lengthen the distance between the projection portion 51 of the male housing corresponding to the axis of rotation and the operation portion 65 corresponding to the power point. Accordingly, it is possible to increase the force by which the engagement projection 79 presses the engagement step portion 99 of the hood portion 89 due to the lever effect of the rotating lever 41.

By displacing the lever 41 previously displaced to another side relative to the fitting position to one side at a time of fitting the male housing 39 to the female housing 45, it is possible to arrange the lever 41 at the fitting position in a state in which the male housing 39 and the female housing 45 are fitted.

Accordingly, when fitting the male housing 39 to the female housing 45, it is possible to compensate for a loss corresponding to the component force in the direction crossing with the vertical direction of the force applied to the projection portion 51 by increasing the force for moving the male housing 39 downward. Further, in a state in which the male housing 39 and the female housing 45 are fitted to each other, it is possible to securely receive the lever 41 within the hood portion 89 of the female housing 45 together with the male housing 39.

As a result, in the lever type connector 37, it is possible to improve an operability of the fitting operation between the male housing 39 and the female housing 45 without enlargement.

In the lever type connector 37 according to the present embodiment mentioned above, when fitting the male housing 39 to the female housing 45, it is possible to move the male housing 39 downward so that the engagement hole 75 of the lever 41 displacing to one side slides the projection portion 51, in addition to the lever effect obtained by the rotation of the lever 41, and the component force in the vertical direction applied to the projection portion 51 by the pressing force pressing the operation portion 65.

In the lever type connector 37, it is possible to further increase the force for moving the male housing 39 downward, when fitting the male housing 39 to the female housing 45. Accordingly, it is possible to further improve the operability of the fitting operation between the male housing 39 and the female housing 45.

In the lever type connector 37, when displacing the lever 41 to another side with respect to the fitting position in the normal state, the holding step portion 81 of the lever 41 and the holding step portion 57 of the male housing 39 are fitted to each other so as to maintain the displacement of the lever 41 to another side. Accordingly, it is possible to further improve the operability of the fitting operation between the male housing 39 and the female housing 45.

In the lever type connector 37, when the male housing 39 moves downward at the time of fitting the male housing 39 to the female housing 45, the slide guiding portion 71 of the lever 41 previously displaced to another side with respect to the fitting position can slide the opening edge in another side of the hood portion 89 so as to displace the lever 41 to one side. Accordingly, in the lever type connector 37, it is possible to further improve the operability of the fitting operation.

In the lever type connector 37 according to the embodiment mentioned above, the engagement hole 75 of the lever 41 is gradually inclined downward from one side toward another side with respect to the direction crossing with the vertical direction. However, the structure may be made such as to be gradually inclined upward from one side toward another side, or be formed in a direction along the direction crossing with the vertical direction or in a direction along the longitudinal direction of the lever 41.

In the lever type connector 37, the engagement hole 75 is provided in the lever 41, and the projection portion 51 is provided to the male housing 39. However, the structure may be made such that the engagement hole 75 is provided in the male housing, and the projection portion 51 is provided in the lever.

The lever type connector 37 is provided with the holding step portions 57 and 81, and the slide guiding portion 71, however, both or any one may be omitted.

A description will be given below of a second embodiment of the lever type connector according to the present invention with reference to FIG. 8. In this case, the same reference numerals are attached to the same constituting elements as those of the embodiment mentioned above, and a detailed description will be omitted.

In the lever type connector 37 according to the first embodiment mentioned above, the engagement hole 75 of the connection portion 43 is formed in a substantially straight long hole. However, in a lever type connector 107 according to the second embodiment, engagement hole 111 in a connection portion 109 is formed in a long hole in which a middle portion is curved.

Figure 8:
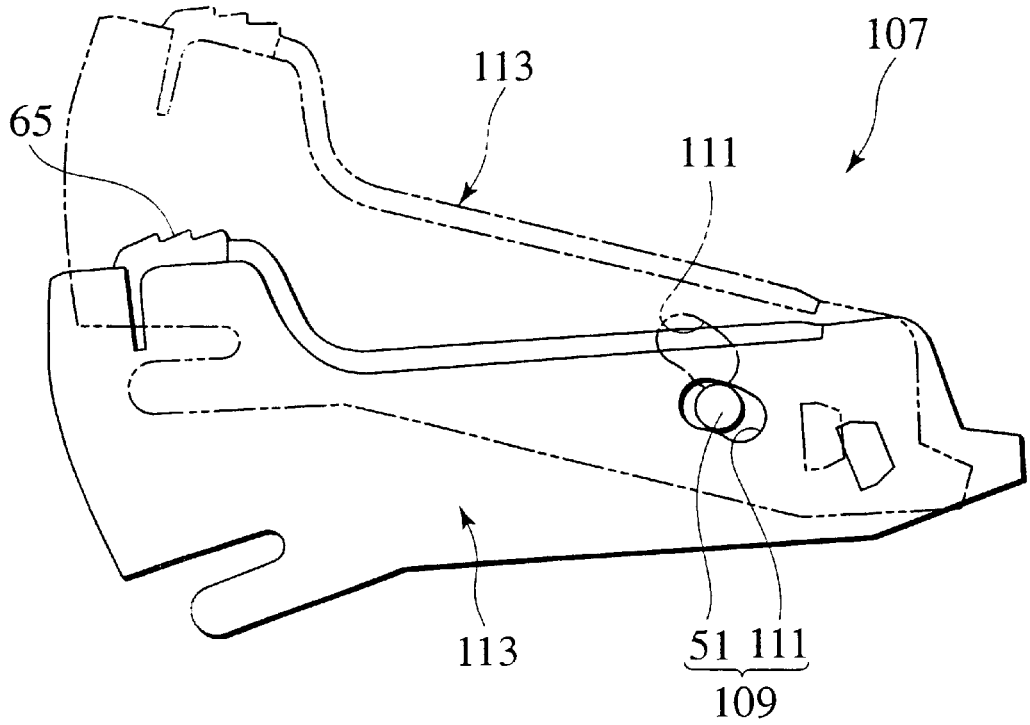
FIG. 8 shows a side view at a time when a lever in a second embodiment of the lever type connector according to the present invention is displaced to one side.
Figure 9:
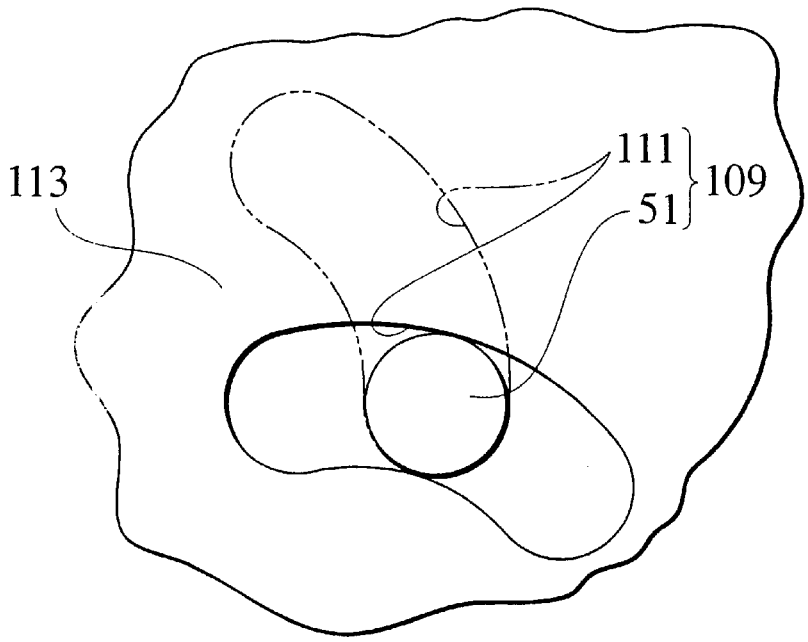
FIG. 9 shows a side view showing a connection portion at a time when the lever shown in FIG. 8 rotates to a predetermined rotational position.

As shown in FIGS. 8 and 9, the engagement hole 111 is gradually inclined upward along the direction crossing with the vertical direction corresponding to the fitting direction between the male housing 39 and the female housing 45, both of which are not shown, from one side to another side. Further, a middle portion between one side and another side is curved to an upper portion corresponding to a rear end side in the fitting direction between the male housing 39 and the female housing 45.

As shown by a chain double-dashed line in FIGS. 8 and 9, in the normal state of the lever 113, the engagement hole 111 is constituted by a long hole formed toward one side of the lever 113. The engagement hole 111 is structured such that a portion between one side and a middle portion is gradually inclined slightly to another side toward an upper portion substantially along the vertical direction, and a portion between the middle portion and another side is gradually inclined slightly to the upper portion toward another side of the lever 113. As shown in FIG. 9, the engagement hole 111 is formed so that the lever 113 substantially crosses with the vertical direction from the middle portion to another side at a predetermined rotational position.

In the lever type connector 107 according to the present embodiment, in the same manner as the first embodiment mentioned above, when fitting the male housing 39 to the female housing 45, it is possible to move the male housing 39 downward so that the engagement hole 111 of the lever 113 displacing to one side slides the projection portion 51, in addition to the lever effect generated by the rotation of the lever 113 and the component force in the vertical direction applied to the projection portion 51 by the pressing force pressing the operation portion 65.

In the lever type connector 107, the engagement hole 111 of the connection portion 113 slides the projection portion 51 in correspondence to the rotation of the lever 113 so as to shift the engagement position with the projection portion 51 from one side to the middle portion side. As shown in FIG. 9, when the lever 113 is at a predetermined rotational position where the lever 113 displaces to one side, the portion between the middle portion and another side in the engagement hole 111 is in a state of substantially crossing with the vertical direction. Then, the middle portion of the engagement hole 111 is engaged with the projection portion 51.

As shown in FIG. 8, in the lever type connector 107, when the lever 113 displaces to one side, the projection portion 51 is slid from the middle portion of the engagement hole 111 to another side, and the projection portion 51 is pressed to the lower portion substantially along the vertical direction. Accordingly, it is possible to reduce the generation of component force in the direction crossing with the vertical direction.

As a result, in the lever type connector 107, when fitting the male housing 39 to the female housing 45, it is possible to further increase the force for moving the male housing 39 downward. Accordingly, it is possible to further improve the operability of the fitting operation between the male housing 39 and the female housing 45.

In the lever type connector 107, in the state of displacing the lever 113 to another side with respect to the fitting position, the projection portion 51 of the connection portion 113 engages with one side with respect to the middle portion being substantially along the vertical direction of the engagement hole 111. Accordingly, when inserting the male housing 39 within the hood portion 89 of the female housing 45 at a time of fitting the male housing 39 to the female housing 45, or the like, it is possible to prevent the lever 113 from being shaky in the direction crossing with the vertical direction with respect to the male housing 39.

The lever type connector 107 according to the present embodiment is formed so that it substantially crosses with the vertical direction at a predetermined rotational position of the lever 113 from the middle portion of the engagement hole 109 to another side. However, the structure may be formed so as to be slightly inclined in the direction crossing with the vertical direction at the predetermined rotational position of the lever 113.

The entire content of a Japanese Patent Application No. P2001-165106 with a filing date of May 31, 2001 is incorporated herein by reference.

Although the invention has been described above by reference to certain embodiments of the invention, the invention is not limited to the embodiments described above will occur to these skilled in the art, in light of the teachings. The scope of the invention is defined with reference to the following claims.

What is claimed is:

1. A lever type connector comprising:

a male housing;

a lever in which a portion between a first side and a second side in a longitudinal direction is rotatably pivoted to the male housing;

a female housing for receiving and fitting the male housing;

a projection portion provided to either one of the male housing and the lever; and an engagement hole provided in the other of the male housing and the lever, engaging with the projection portion, wherein the engagement hole is formed to be longer toward one of the first and second sides of the lever with respect to the projection portion, and wherein the lever is adapted to be longitudinally displaced with respect to the male housing when the male housing and the female housing are moved to a fitting state.

2. The lever type connector according to claim 1, wherein the projection portion is provided to the male housing and the engagement hole is provided in the lever.

3. The lever type connector according to claim 1, wherein the engagement hole is gradually inclined from the first side of the lever toward the second side of the lever in the normal state of the lever.

4. The lever type connector according to claim 1, wherein the engagement hole is gradually inclined toward an upper portion in a fitting direction of the male housing to the female housing, the engagement hole extending in a direction from the second side of the lever toward the first side in the normal state of the lever, and wherein a middle portion of the engagement hole is curved toward the upper portion, and the engagement hole crosses the fitting direction at a predetermined rotational position of the lever, the predetermined rotational position being between the middle portion and the upper portion, or the engagement hole is slightly inclined in a direction crossing with the fitting direction.

5. The lever type connector according to claim 1, further comprising:

a holding step portion provided in each of the lever and the male housing, and engaging with each other when displacing the lever toward a side of the connector with respect to the fitting position in the normal state.

6. The lever type connector according to claim 1, further comprising:

a slide guiding portion provided in the second side of the lever, which slides along a side of the female housing when the lever rotates.

7. The lever type connector according to claim 3, wherein the engagement hole is gradually inclined in a fitting direction from the first side of the lever toward the second side with respect to a direction crossing with the fitting direction of the male housing to the female housing in the normal state of the lever.

8. The lever type connector according to claim 3, wherein the engagement hole is gradually inclined in a reverse direction to a fitting direction from the first side toward the second side with respect to a direction crossing with the fitting direction of the male housing to the female housing in the normal state of the lever.

9. The lever type connector according to claim 3, wherein the engagement hole is gradually inclined along a direction crossing with the fitting direction of the male housing to the female housing in the normal state of the lever.

10. The lever type connector according to claim 3, wherein the engagement hole is inclined in the longitudinal direction of the lever.

* * * * *